US007841047B2

(12) United States Patent
Juntunen

(10) Patent No.: US 7,841,047 B2
(45) Date of Patent: Nov. 30, 2010

(54) CONTROL VALVE FOR DOOR CLOSER

(75) Inventor: Harri Juntunen, Joensuu (FI)

(73) Assignee: Abloy Oy (FI)

( * ) Notice: Subject to any disclaimer, the term of this patent is extended or adjusted under 35 U.S.C. 154(b) by 241 days.

(21) Appl. No.: 10/598,728

(22) PCT Filed: Mar. 2, 2005

(86) PCT No.: PCT/FI2005/050056

§ 371 (c)(1),
(2), (4) Date: Sep. 8, 2006

(87) PCT Pub. No.: WO2005/085573

PCT Pub. Date: Sep. 15, 2005

(65) Prior Publication Data

US 2008/0229543 A1 Sep. 25, 2008

(30) Foreign Application Priority Data

Mar. 10, 2004 (FI) ..... 20040381

(51) Int. Cl.
*E05F 3/04* (2006.01)

(52) U.S. Cl. ..... 16/51; 16/58

(58) Field of Classification Search ..... 16/51, 16/58, DIG. 21; 251/122, 215, 218, 264
See application file for complete search history.

(56) References Cited

U.S. PATENT DOCUMENTS 2,275,624 A * 3/1942 Hann ..... 251/122
3,467,357 A * 9/1969 Weise et al. ..... 251/214
4,185,807 A * 1/1980 Milliren ..... 251/218
4,665,583 A 5/1987 Frolov et al.
4,969,628 A * 11/1990 Reich et al. ..... 251/122
5,027,919 A * 7/1991 Silva et al. ..... 251/122
5,083,749 A * 1/1992 Linderman et al. ..... 251/214
5,118,073 A * 6/1992 Hutton ..... 251/88
5,992,444 A * 11/1999 Junttila ..... 137/599.11
6,112,368 A * 9/2000 Luckett ..... 16/59
2004/0149949 A1* 8/2004 Eriksson et al. ..... 251/186
2005/0173667 A1* 8/2005 Zheng ..... 251/282

FOREIGN PATENT DOCUMENTS

AT 293218 9/1971
DE 10228872 1/2004

* cited by examiner

*Primary Examiner*—Victor Batson
*Assistant Examiner*—Jeffrey O'Brien
(74) *Attorney, Agent, or Firm*—Chernoff, Vilhauer, McClung & Stenzel

(57) ABSTRACT

The invention relates to door closers, particularly a door closer control device that regulates the flow of a pressure medium controlling the function of a door closer. A control device according to the invention includes a support part with a collar that serves as a second support for the control device on the door closer body in addition to the support in the guiding part. This second support holds the control device in place within the pressure medium flow without any rocking or swaying movement, which would hamper the door closing speed.

10 Claims, 3 Drawing Sheets

CONTROL VALVE FOR DOOR CLOSER

This is, a national stage application filed under 35 USC 371 based on International Application No. PCT/FI2005/050056 filed Mar. 2, 2005, and claims priority under 35 USC 119 of Finnish Patent Application No. 20040381 filed Mar. 10, 2004.

FIELD OF TECHNOLOGY

The invention relates to door closers, particularly a door closer control device that regulates the flow of a pressure medium controlling the function of a door closer. Furthermore, the invention relates to the pressure medium flow system of a door closer.

PRIOR ART

Figure 1:
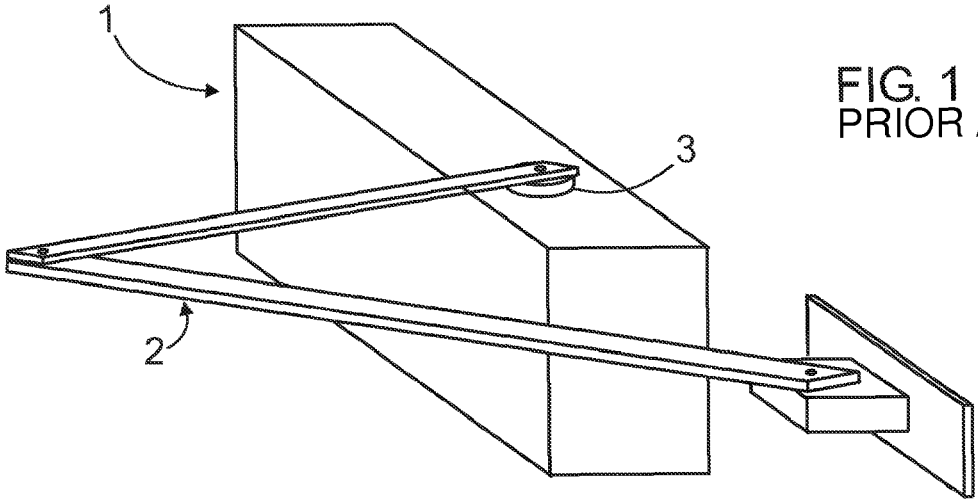
FIG. 1 PRIOR ART

The purpose of a door closer is to close a door after being opened, eliminating the need to separately close it. FIG. 1 illustrates an example of a door closer 1. A shaft 3 is fitted to the door closer body, and a lever arm 2 is attached to the shaft. The other end of the lever arm can be fitted to the door. There is a spring and a piston inside the door closer. The piston is connected to the shaft. When the door is opened, the lever arm turns the shaft, which moves the piston. The moving piston compresses the spring. Once the door has been opened, the spring imposes a pushing force on the piston, which turns the shaft. The turning motion of the shaft moves the lever arm to close the door.

Figure 2:
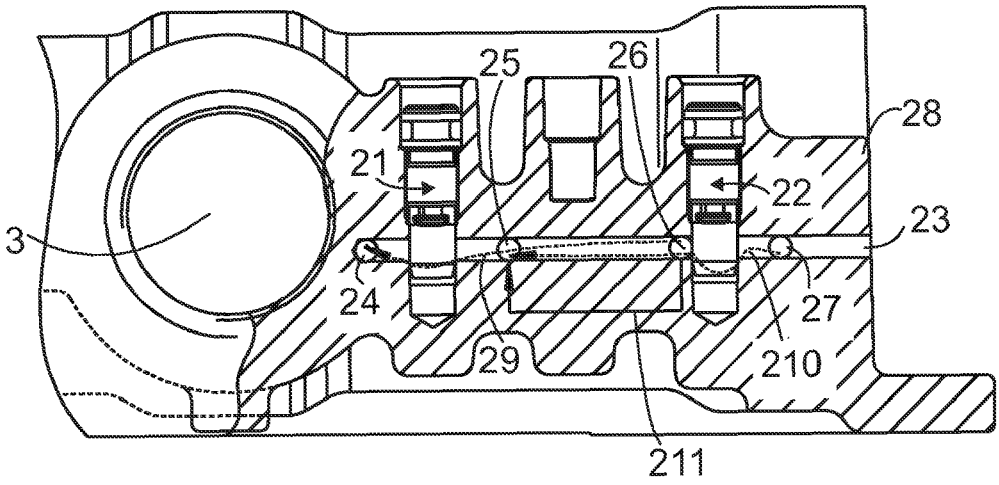
FIG. 2 PRIOR ART

FIG. 2 is a more detailed illustration of a prior art door closer structure. To make the door closer function smooth, a pressure medium flowing from one side of the piston to another is used in door closers. The flow of the pressure medium affects the speed of the door closing. The pressure medium is generally oil suitable for the purpose. FIG. 2 does not show the door closer piston but the channel 23 in the door closer body 28, through which the oil can flow to the opposite side of the piston. In this embodiment, the oil flow is restricted by two control valves 21, 22. The purpose of the first valve 21 is to control the speed of closing at door angles from 180° to 10°. The purpose of the second valve 22 is to control the speed of closing at door angles from 10° to 0°. The figure also shows the channels 24, 25, 26, 27 to the cylinder where the piston is located.

In the following, the situation where the door is closing is examined by referring to FIG. 2. First, the piston, which is being moved by the spring force, tries to move the oil in the cylinder to the opposite side of the piston through the channels 26, 23 and 24. The dashed line 29 illustrates this flow. The first control device 21 sets an appropriate restriction for the flow at larger door angles. Once the door reaches an angle of 10 degrees, the piston has moved enough to close the channel 26 in the cylinder. Correspondingly, the channels 27 and 25 are open when the piston no longer prevents flow in the cylinder. At this stage, the oil tries to flow to the other side of the piston through the channels 27, 23 and 25. The other dashed line 210 illustrates this flow. The second control device 22 sets an appropriate restriction for this flow. Because the piston moving in the cylinder does not make up a completely tight surface against the cylinder wall, by-pass leakage occurs in the channels at a certain phase of the piston movement. At this stage, part of the oil flows to the other side of the piston through the channels 26, 23 and 25. The line 211 illustrates this flow.

Figure 3:
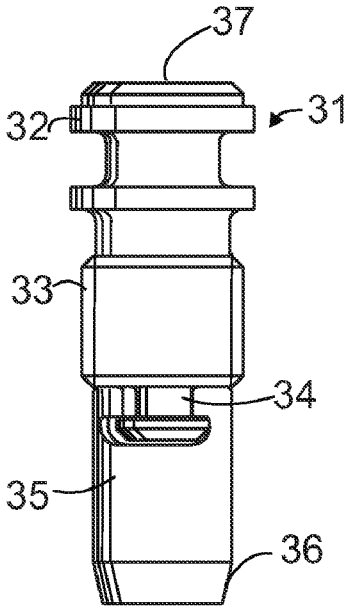
FIG. 3 PRIOR ART

FIG. 3 is a more detailed illustration of a particular embodiment of the control device 31, also known as the control valve, which is used to restrict oil flow in the channels of the door closer. The basic form of the control valve is cylindrical, and it comprises two main parts: a guiding part 32 and a control part 35. The guiding part is fitted with a thread fillet 33 by which the control valve can be supported on the door closer body 28 (FIG. 2). There is a bevelling 36 in the free end of the control part, allowing the flow of the pressure medium to bypass the control valve in the door closer channel 23. The control valve can be moved in the axial direction by turning it by the end of the guiding part 37 (using an Allen wrench, for example, if a hex socket is formed at the end), making the control part and its bevelling restrict the flow in the channel 23 to the desired extent. In other words, the control valve is used to adjust the cross-sectional area of the flow in the channel at the valve position. It can be noted that if the control part had no bevelling, the regulating properties of the control valve would be significantly more limited.

The control part 35 and the guiding part 32 can be made of different materials. The use of plastic as a control part material is well known. In the example of FIG. 3, a control part of a different material is fitted to a fastening bracket 34 in the guiding part.

In publication AT 293218, a control screw is described in a door closer, in which screw a tap exists on the bezel end side, which purpose is to provide a certain kind of support. The screw is made of one material, i.e. hard metal. However, margin must be left between the support and the body of the door closer so that the screw could be installed in position.

The problem with prior art control devices or control valves is that the control valve tends to rock and sway in the pressure medium flow. This causes jerking in the door closing motion and may even momentarily stop it. The rocking and swaying movement is a particular problem at higher oil pressures and embodiments where the control part is of a resilient material such as plastic.

The purpose of the invention is to eliminate the problem of uneven closing mentioned in the above. The purpose can be achieved by the means presented in the claims.

SHORT DESCRIPTION OF INVENTION

A control device according to the invention includes a support part at the control part end of the control device, after the bevelling when viewed from the direction of the guiding part.

The collar that can be placed around the support part and is preferably made of a resilient material provides a second support for the control device on the door closer body in addition to the support in the guiding part. So, the collar comprises a supporting surface that can be placed against the body of the control device. This second support holds the control device in place within the pressure medium flow without any rocking or swaying movement, which would hamper the door closing speed. The invention also prevents axial movement of the control device.

Thus the control device according to the invention, intended for regulating the pressure medium flow that controls the function of a door closer utilizing a pressure medium, comprises a guiding part of the control device, which can be supported on the door closer body using a thread fillet, a control part with a bevelling for regulating the pressure medium flow, and a support part that can be fitted with a collar at the bevelled end of the control part for supporting the control device on the door closer body and holding the control device in position in the pressure medium flow through the collar. The collar comprises a supporting surface that can be placed against the body of the control device.

In an embodiment of the invention, the collar comprises at least one chase to reduce its thickness at a certain part of the collar. The collar can preferably be preinstalled in the door closer body. When the control device is installed in the door closer, the support part of the control device becomes seated in the collar. The collar is preferably made of a resilient material such as plastic.

Furthermore, the by-pass leakage of the pressure medium that hampers the door closing speed is eliminated by using two different channels that provide a route for the pressure medium to the opposite side of the piston. The first channel is for greater door angles and the second channel is for small angles.

LIST OF FIGURES

Figure 4:
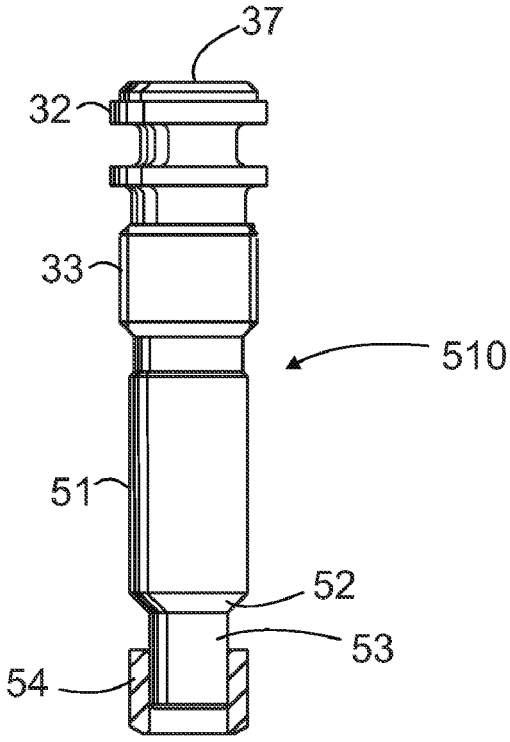
Figure 5:
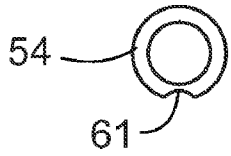
Figure 6:
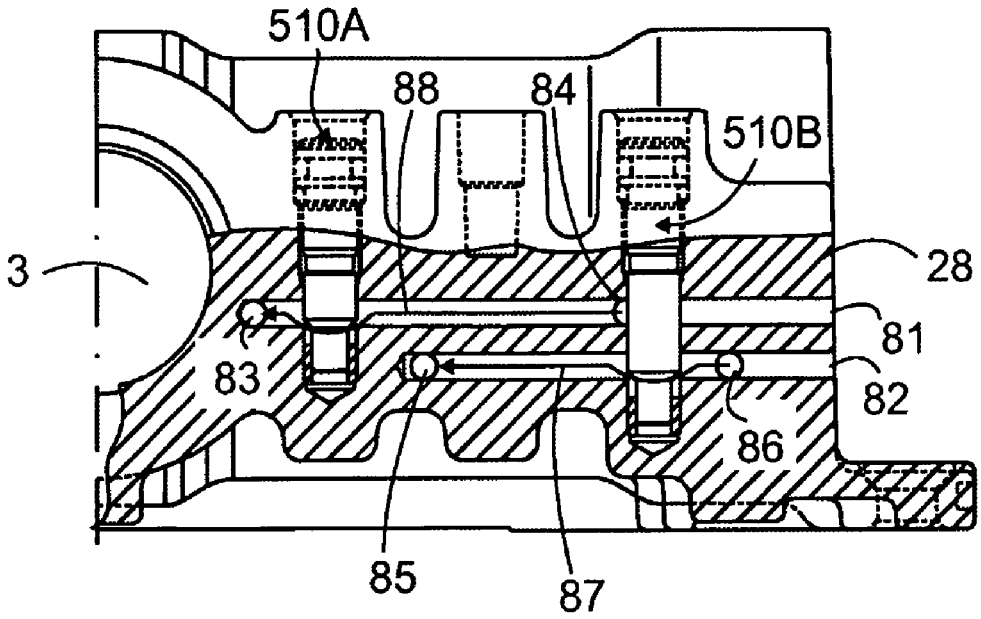

In the following, the invention is described in more detail by reference to the enclosed drawings, where FIG. 1 illustrates an example of a prior art door closer, FIG. 2 illustrates an example of the structure of a prior art door closer, FIG. 3 illustrates a prior art embodiment of a control device, FIG. 4 illustrates an embodiment of a control device according to the invention, FIG. 5 illustrates a collar that can be applied to the embodiment of FIG. 4, FIG. 6 illustrates an installation example utilizing the embodiment of FIG. 4, and a dual-channel system.

DESCRIPTION OF THE INVENTION

FIG. 4 illustrates an embodiment of the invention 510. Similar to prior art control devices, the control device 510 according to the invention has a cylindrical basic form and comprises a guiding part 32 and a control part 51. The guiding part is fitted with a thread fillet 33 by which the control valve can be supported on the door closer body 28 (FIG. 2). There is a bevelling 52 in the free end of the control part, allowing the flow of the pressure medium to bypass the control valve in the door closer channel 23. The control valve can be moved in the axial direction by turning it in relation to the door closer body by the end of the guiding part 37, making the control part and its bevelling restrict the flow in the channel 23; thus, the control device restricts the cross-sectional area of the flow in the channel at the control device position. The bevelled end of the control part contains a support part 53, around which exists a collar 54 that provides a supporting surface against the door closer body. The supporting surface rests on the door closer body when the control device is installed in a door closer.

The control device according to the invention does not rock or sway in the pressure medium flow. In order to achieve good controllability, the clearance between the control device and the door closer body must be small. A large clearance increases the swaying motion of the control device. The control valve and the valve housings may not have any angle of taper. It is difficult and expensive to manufacture control valves and valve housings with small tolerances. Due to this, it is preferable to use a resilient material that allows larger tolerances. Sufficient compression of the collar of the support part against the body prevents unwanted axial movement.

The invention also prevents axial movement of the control device. It is a fairly common problem that the control valve tends to unscrew due to the effect of the oil and its pressure. Thus the control valve can start to unscrew over time, making the twisting gradually stronger and putting the control valve out of adjustment. The invention intends to hold the control device in place in all directions.

As described in the above, the collar 54 is preferably made of a resilient material, such as plastic or soft metal (including alloys). The collar can be placed in the door closer before installing the control device, after which the control screw is placed inside the collar by pulling with a thread fillet, for example. Another option is to place the collar in the control device first, after which the control device with the collar is placed in the door closer. It should be noted that the collar's pressure against the door closer body prevents the control device from unscrewing. The collar may also have a chase 61 at a certain location to reduce the thickness of the collar as illustrated in FIG. 6, for example. The chase improves the resilience and consequently the installability of the collar. The collar may also have several chases. The advantage of using a resilient material is that the control device can be fitted in the door closer body without any clearance. A soft material such as plastic allows larger tolerances than conventional metals (such as aluminium and/or brass).

In addition to the examples described in the above, a control device according to the invention can also be implemented using other embodiments. For example, the control device end 37 may have a hex socket, a crosshead socket or a simple groove for turning the control device. However, a control device according to the invention always includes a guiding part, a control part and a support part with a collar. The support part can be metal, and the same is true for the control part. The guiding part is preferably metal. The different parts may be manufactured of a common solid part, such as brass, or they can be manufactured separately and assembled together later. A preferred embodiment is one where the guiding part, control part and support part are manufactured of the same solid metal, and the collar is plastic.

As previously already referred to FIG. 2, oil by-pass leakage occurs in channel 23 through the channels 26 and 25. In order to solve the by-pass leakage problem, separate channels are formed for both control devices 510. FIG. 6 illustrates an installation example utilizing the embodiment of FIG. 4, where the door closer contains a dual-channel system. The first valve 510A regulates the closing speed at door angles from 180° to 10°. The pressure medium flows through the channels 84, 81 and 83 to the opposite side of the piston. The arrow 88 illustrates this flow. The purpose of the second valve 510B is to control the speed of closing at door angles from 10° to 0°. The pressure medium flows through the channels 86, 82 and 85 to the opposite side of the piston. The arrow 87 illustrates this flow. The dual-channel system makes it possible to eliminate the adverse by-pass leakage.

The channels 81 and 82 in FIG. 6 are preferably on top of each other in the same plane. Thus the control valves 510A and 510B are in the same plane with the channels as well. This solution is preferred because it saves space in the door closer body. Due to this, one of the channels (in this case channel 81) is routed via both control valves. It should be noted that in the arrangement according to FIG. 8, the control valve 510B does not encumber the flow 88 controlled by the control valve 510A (such as by-pass leakage to channel 82). If the channels 81 and 82 were on different planes, the door closer body would be thicker (in the direction perpendicular to the plane of FIG. 6) and more body material would be required for manufacturing.

It is evident from the above that the invention is not limited to the embodiments described in this text but can be implemented in many other different embodiments within the scope of the inventive idea.

The invention claimed is:

1. A door closer including:

a door closer body formed with at least one channel for flow of a pressure medium controlling operation of the door closer and also formed with at least one bore that intersects the channel and has first and second segments at opposite respective sides of the channel, and a control device fitted in the bore and having first and second opposite ends, the control device comprising a guiding part at its first end, the guiding part being located in the first segment of the bore and having a thread fillet engaging the door closer body and supporting the control device relative to the door closer body, a support part at the second end of the control device, the support part being located in the second segment of the bore, a collar of resilient material located in the second segment of the bore and surrounding the support part of the control device, the collar being under compression whereby the collar supports the second end of the control device relative to the door closer body and restrains the control device against rocking and swaying movement relative to the door closer body due to flow of pressure medium in said channel, and a control part between the guiding part and the support part and having a beveled inner end for cooperating with the door closer body to restrict pressure medium flow in said channel, whereby the control device can be moved in its axial direction by turning the control device supported on the door closer body for adjusting the restriction of the pressure medium flow by the control part, wherein the collar has at least one chase to reduce its thickness at a certain part of the collar, and wherein the control part, the guiding part and the support part of the control device are metal and the collar is plastic, and the control part, the guiding part and the support part are axially movable relative to the collar.

2. A door closer according to claim 1, wherein said second segment of the bore is blind.

3. A door closer according to claim 1, wherein the support part of the control device is smaller in diameter than the control part of the control device.

4. A door closer including:

a door closer body formed with first and second channels for flow of a pressure medium controlling operation of the door closer and also formed with a first bore that intersects the first channel and has first and second segments at opposite respective sides of the first channel, and with a second bore that intersects both the first channel and the second channel and has first and second segments at opposite respective sides of the second channel, a first control device fitted in the first bore and having first and second opposite ends, the first control device comprising a guiding part at its first end, the guiding part being located in the first segment of the first bore and having a thread fillet engaging the door closer body and supporting the first control device relative to the door closer body, a support part at the second end of the first control device, the support part being located in the second segment of the first bore, a collar of resilient material located in the second segment of the first bore and surrounding the support part of the first control device, the collar being under compression whereby the collar supports the second end of the first control device relative to the door closer body and restrains the first control device against rocking and swaying movement relative to the door closer body due to flow of pressure medium in said first channel, and a control part between the guiding part and the support part and having a beveled inner end for cooperating with the door closer body to restrict pressure medium flow in said first channel, a second control device fitted in the second bore and having first and second opposite ends, the second control device comprising a guiding part at its first end, the guiding part being located in the first segment of the second bore and having a thread fillet engaging the door closer body and supporting the second control device relative to the door closer body, a support part at the second end of the second control device, the support part being located in the second segment of the second bore, and a control part between the guiding part and the support part and having a beveled inner end for cooperating with the door closer body to restrict pressure medium flow in said second channel, whereby the first control device can be moved in its axial direction by turning the first control device supported on the door closer body for adjusting the restriction of the pressure medium flow by the control part of the first control device and the second control device can be moved in its axial direction by turning the second control device supported on the door closer body for adjusting the restriction of the pressure medium flow by the control part of the second control device, wherein the collar has at least one chase to reduce its thickness at a certain part of the collar, and wherein the control part, the guiding part and the support part of the first control device are made of metal and the collar is made of plastic, and the control part, the guiding part and the support part of the first control device are axially movable relative to the collar.

5. A door closer according to claim 4, wherein said second segment of the first bore is blind.

6. A door closer according to claim 4, comprising a second collar of resilient material located in the second segment of the second bore and surrounding the support part of the second control device, the second collar being under compression whereby the second collar supports the second end of the second control device relative to the door closer body and restrains the second control device against rocking and swaying movement relative to the door closer body due to flow of pressure medium in said second channel.

7. A door closer according to claim 4, wherein the support part of the first control device is smaller in diameter than the control part of the first control device.

8. A door closer according to claim 4, wherein the second control device includes a collar of resilient material located in the second segment of the second bore and surrounding the support part of the second control device, the collar being under compression whereby the collar supports the second end of the second control device relative to the door closer body and restrains the second control device against rocking and swaying movement relative to the door closer body due to flow of pressure medium in said second channel, and wherein the control part, the guiding part and the support part of the second control device are made of metal and the collar is made of plastic, and the control part, the guiding part and the support part of the second control device are movable relative to the collar axially of the second bore.

9. A door closer according to claim 4, wherein the first channel has first and second segments at opposite respective sides of the first bore, with the first segment being between the first bore and the second bore, and the door closer body is formed with third and fourth channels that open into the first and second segments respectively of the first channel, whereby the first control device controls flow of pressure medium between the third and fourth channels and the second control device does not substantially encumber flow of pressure medium between the third and fourth channels.

10. A door closer according to claim 9, wherein the second channel has first and second segments at opposite respective sides of the second bore, and the door closer body is formed with fifth and sixth channels that open into the first and second segments respectively of the second channel, whereby the second control device controls flow of pressure medium between the fifth and sixth channels.

* * * * *